US005303209A

United States Patent [19]

Frasl

[11] Patent Number: 5,303,209

[45] Date of Patent: Apr. 12, 1994

[54] ELECTROACOUSTIC TRANSDUCER HAVING A PARTITION WALL AND A MASK WALL

[75] Inventor: Ewald Frasl, Biedermannsdorf, Austria

[73] Assignee: U.S. Philips Corporation, New York, N.Y.

[21] Appl. No.: 78,718

[22] Filed: Jun. 16, 1993

[30] Foreign Application Priority Data

Mar. 4, 1993 [AT] Austria ..... 419/93

[51] Int. Cl.[5] ..... H04R 21/00

[52] U.S. Cl. ..... 367/174; 181/160; 381/90; 381/159; 381/192

[58] Field of Search ..... 367/174; 181/148, 160; 381/90, 153, 159, 192, 168

[56] References Cited

U.S. PATENT DOCUMENTS 4,027,116 5/1977 Nakamura ..... 179/180
4,054,748 10/1977 Balogh ..... 181/199
4,860,368 8/1989 Payer et al. ..... 381/159
4,918,738 4/1990 Bader ..... 381/190
4,949,387 8/1990 Andert et al. ..... 381/190
5,166,984 11/1992 Hsiao ..... 381/199

*Primary Examiner*—J. Woodrow Eldred
*Attorney, Agent, or Firm*—Paul R. Miller

[57] ABSTRACT

In an electroacoustic transducer (1) having a diaphragm (5), behind which a partition wall (24) is situated, which partition wall extends transversely of the transducer axis (9) and is traversed by partition openings (29, 30, 31, 32) having a small cross-sectional area of at the most 0.2 mm$^2$, and having a mask wall (38) arranged adjacent the partition wall and provided with mask-wall openings (39, 40, 41, 42) of large cross-sectional area, in the other wall (38) being coincident with at least one opening (29, 30, 31, 32) of small cross-sectional area, each opening (29, 30, 31, 32) of small cross-sectional area is situated between two spacer elements (49, 50, 51, 52, 53, 54, 55, 56) arranged between the two walls (24, 38), and each time two spacer elements (49, 50, 51, 52, 53, 54, 55, 56) together with the two walls (34, 38) bound a duct-like gap (57, 58, 59, 60) between the two walls (24, 38) in order to form an acoustic resistance.

10 Claims, 1 Drawing Sheet

ELECTROACOUSTIC TRANSDUCER HAVING A PARTITION WALL AND A MASK WALL

Figure 1:
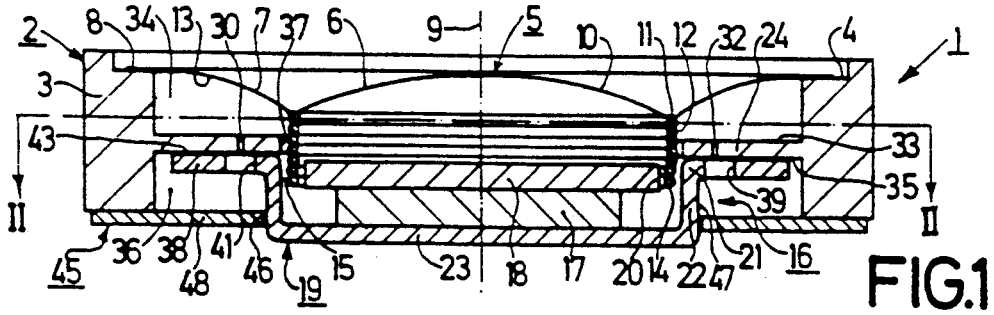

The invention relates to an electroacoustic transducer having a diaphragm constructed to be capable of vibration parallel to a transducer axis, which transducer comprises a partition wall facing the back of the diaphragm, which partition wall substantially extends transversely of the transducer axis and is traversed by at least one partition opening to form a passage between a first space situated between the diaphragm and one side of the partition wall and a second space situated at the other side of the partition wall, which partition wall is formed with and surrounds a central passage belonging to the first space, and a mask wall arranged adjacent one of the two sides of the partition wall and having at least one mask-wall opening to form a passage between the two spaces, which mask wall is connected in a mechanically rigid manner to the partition wall by means of a continuous acoustically sealed joint situated radially outside the openings in the two walls, one of the two walls being provided with at least one opening having a small cross-sectional area of at the most 0.2 $mm^2$ and an opening of large cross-sectional area in the other wall being coincident with at least one opening of small cross-sectional area in the one wall to form at least one passage having a small acoustically active cross-sectional area between the two spaces in the direction of the transducer axis.

BACKGROUND OF THE INVENTION

An electroacoustic transducer of the type defined in the opening paragraph and known to the applicant has been obtained as the result of the development of a new electroacoustic transducer by the applicant and is described in Austrian Patent Applications A 367/93 and A 368/93 both filed on Feb. 26, 1993 (herewith incorporated by reference).

In the transducers known to the applicant the partition wall and the mask wall are connected to one another in an acoustically sealed and mechanically rigid manner by means of an adhesive joint in a peripheral area of the mask wall. The adhesive joint is only very thin so that the two adjacent walls, i.e. the partition wall and the mask wall of the transducer, adjoin one another almost directly. The mask wall is formed by a flange of a pot of a magnet system of the transducer, which pot imperviously closes the first space of the transducer at the location of the back of the partition wall, which space extends through the central opening in the partition wall, so that in the known transducer the first space, which is situated partly between the diaphragm and one side of the partition wall, and the second space, which is situated at the other side of the partition wall, communicate with one another only via the acoustically active passages formed by the coincident openings in the partition wall and in the mask wall and for the remainder are wholly acoustically isolated from one another. The two spaces each form an acoustic capacitance and the acoustically active passage formed by two coincident openings in the two walls each form an acoustic inductance and an acoustic resistance arranged in series with this inductance, the essential part of each passage being formed by the opening having the smaller cross-sectional area, which determines the magnitude of the inductance and the magnitude of the series resistance. The magnitude of the series resistance is determined by the cross-sectional area and also by length, in the direction of the transducer axis, of the opening having the smaller cross-sectional area. However, the length of such an opening is relatively limited for reasons of production, so that altogether only an acoustic series resistance of comparatively small value is obtained. The two spaces in conjunction with the acoustically active passages between the spaces form two so-called Helmholtz resonators of which the resonance characteristics and hence the resonance step-ups are determined by the values of the acoustic capacitances and by the values of the acoustic inductances and series resistances formed by the passages. With the transducer known to the applicant it has now been found that as a result of the comparatively small values of the acoustic series resistances attainable with the openings of small cross-sectional area the Helmholtz resonators have a comparatively high Q factor and the resonators therefore have only a small damping, so that their resonance step-ups are comparatively pronounced, which leads to a rippled frequency response of the transducer.

SUMMARY OF THE INVENTION

It is an object of the invention to solve the above problems and to effectively improve an electroacoustic transducer of the type defined in the opening paragraph by simple means in order to obtain a transducer whose frequency response is as smooth as possible. To this end the invention is characterized in that each opening of small cross-sectional area in one of the two walls is situated between two spacer. elements arranged between the two walls and having substantially the same distance from the central passage in the partition wall, and each time two spacer elements together with the two walls circumferentially bound a duct-like gap situated between the two walls and leading to the passage in the partition wall to form an acoustic resistance. By means of the steps in accordance with the invention a so-called acoustic bypass resistance is realized for each opening a small cross-sectional area, which resistance acts in parallel with the acoustic impedance formed by an opening of small cross-sectional area, yielding a smaller overall acoustic impedance at the location of each opening of small cross-sectional area. This has the advantage that it results in a smaller Q factor and hence a stronger damping of the Helmholtz resonators formed by means of the two transducer spaces, which manifests itself in a correct and smooth frequency response of the transducer. A special advantage is that in a transducer in accordance with the invention each acoustically active duct-like gap is circumferentially bounded by the spacer elements between the two walls and by the two walls and has a comparatively accurately defined length up to the opening in the partition wall, which is advantageous for an accurately defined value of the bypass resistance formed by such a gap.

It is to be noted that with a transducer comprising a partition wall having openings and comprising a mask wall arranged adjacent this partition wall and also having openings it is known, for example, from U.S. Pat. No. 4,027,116, to arrange the two walls at a distance from one another and to arrange an acoustic damping means in the form a felt ring in the space between the two walls, which ring forms an additional acoustic resistance at the location of each passage formed by two coincident openings and connecting two transducer spaces which are separated from one another by the partition wall and the mask wall. However, the magnitudes of such additional acoustic resistances formed by a felt material are difficult to control because this magnitude depends to a comparatively large extent on the composition, the density and the fiber structure of the felt material, on the humidity of the felt material and on the ambient temperature of the felt material. Conversely, the magnitude of an additional bypass resistance in accordance with the invention, which resistance is formed by a duct-like gap whose gap height is determined by spacer elements which can be dimensioned accurately and whose gap length is also accurately defined, can be defined accurately because the magnitude is determined by the accurately controllable gap dimensions.

The spacer elements may be formed by spacer vanes which project radially inward from a separate spacer ring which can be interposed between the partition wall and the mask wall. However, it is found to be particularly advantageous if each spacer element is integral with one of the two walls. This has the advantage of a very simple construction.

It is found to be particularly advantageous if each spacer element has a height of between 20 μm and 50 μm in the direction of the transducer axis. Tests have revealed that such a construction provides very good results.

It is also found to be very advantageous if each opening having a small cross-sectional area is of circular cross-section, and the diameter of each such opening of circular cross-section is smaller than 0.3 mm in its acoustically active cross-sectional area. Such openings or holes of small diameter can be made very accurately with given dimensions with very small tolerances, so that such openings provide accurately defined acoustic inductance values and resistance values, which are determined by the ratio between the acoustically active cross-sectional area and length of the opening, so that the passages formed by means of the openings and connecting the two transducer spaces have accurately defined influences on the acoustic characteristics of the transducer.

It is found to be particularly advantageous if the diameter of each such opening of circular cross-section is 0.2 mm in its acoustically active cross-sectional area. Tests have revealed that such a construction provides very good results.

It is also found to be particularly advantageous if each such opening of circular cross-section has a conical shape in its axial direction. This is advantageous for an accurately defined acoustically active cross-sectional area of such an opening, concentrated at the area of smallest diameter of the opening. It is also advantageous when such an opening is to be made in a plastics part in view of easy demoulding.

BRIEF DESCRIPTION OF THE DRAWING FIGURES

Figure 2:
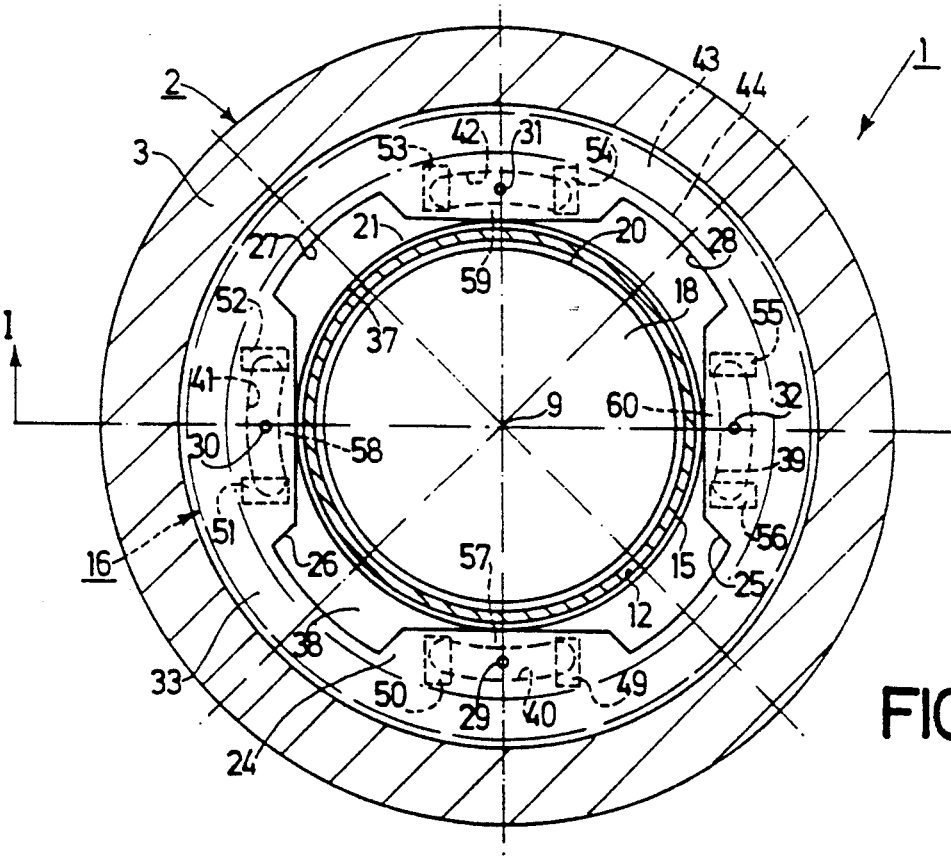
Figure 3:
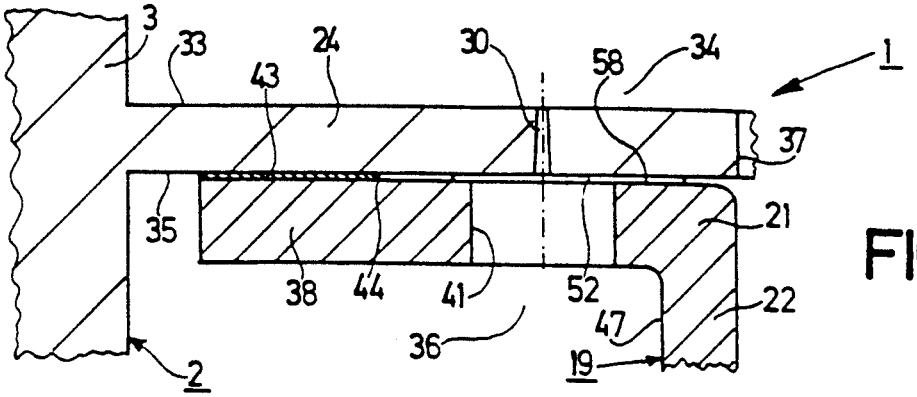

The invention will now be described in more detail with reference to the drawing, which shows an exemplary embodiment to which the invention is not limited. FIG. 1 is a slightly diagrammatical cross-sectional view, taken on the line I—I in FIG. 2 and to a larger than full-size scale, showing an electrodynamic transducer embodying the invention, constructed as a receiver/microphone capsule for telephony purposes and comprising a partition wall with openings and a mask wall with openings, between which walls duct-like gaps are formed by means of spacer elements to define acoustic bypass resistances. FIG. 2 shows the transducer in a sectional view taken on the line II—II in FIG. 1. FIG. 3 is a cross-sectional view to a larger scale than FIG. 1, showing a part of the transducer shown in FIGS. 1 and 2 having conical partition openings in its partition wall.

DESCRIPTION OF THE INVENTION

FIGS. 1 and 2 show an electrodynamic transducer 1 constructed as a receiver/microphone capsule. The transducer 1 has an essentially annular or hollow cylindrical mounting device 2. The mounting device 2 has a cylindrical outer wall 3 having a stepped portion 4 in its area facing a front side of the transducer 1. The stepped portion 4 forms a mounting zone to which a diaphragm 5 of the transducer 1 is secured by an adhesive joint. The diaphragm 5 has a central portion 6, which is often referred to as a dome. The diaphragm 5 further has a peripheral portion 7 provided with hyperbolic corrugations, not shown in FIG. 1. With the outer edge 8 of the peripheral portion 7 the diaphragm 5 is connected to the stepped portion 4 of the mounting device 2 by an adhesive. The diaphragm 5 is constructed to allow back and forth vibration parallel to a transducer axis 9 and from its front side 10 it emits useful waves which are audible in operation.

In the transitional area 11 between the central portion 6 and the peripheral portion 7 of the diaphragm 5 a moving coil 12 is connected to the diaphragm 5 by an adhesive joint. In the present case the moving coil 12 projects into an air gap 15 of a magnet system 16 of the transducer 1 with its part 14 which is remote from the back 13 of the diaphragm. The magnet system 16 comprises a magnet 17, a pole plate 18, and a pot 19, which is often also referred to as outer pot. The air gap 15, in which the part 14 of the moving coil 12 is disposed, is situated between the circumferential bounding surface 20 of the pole plate 18 and the periphery 21 of the hollow cylindrical portion 22, which is closed by the bottom portion 23 of the pot 19.

In the present transducer 1 the mounting device 2 comprises a substantially annular partition wall 24, which projects radially inward from the outer wall 3 and which faces the back 13 of the diaphragm 5 and extends transversely of the transducer axis 9. The partition wall 24 has four partition openings 25, 26, 27, 28 and 29 of substantially slot-shaped and comparatively large cross-sectional area, which traverse the partition wall 24 and which are equispaced at angles of 90° from one another. The partition wall 24 further has four partition openings 29, 30, 31 and 32 of circular and comparatively small cross-sectional area, which also traverse the partition wall 24 and which are equispaced at angles of 90° from one another and spaced at angles of 45° from the respective slot-shaped partition openings 25, 26, 27 and 28. The partition openings 25, 26, 27, 28 and 29, 30, 31, 32 serve to form acoustically active passages between a first space 34 situated between the diaphragm 5 and one side 33 of the partition wall 24 and a second space 36 at the other side 35 of the partition wall 24. In the electrodynamic transducer 1 constructed as a capsule, as shown in FIGS. 1 and 2, the second space 36 is closed at the back of the transducer 1, as will be described in more detail hereinafter. The slot-shaped partition openings 25, 26, 27 and 28 may have a length of, for example, approximately 6 mm. It is found to be advantageous if the circular partition openings 29, 30, 31 and 32 have a diameter smaller than 0.3 mm and preferably 0.2 mm. However, alternatively the circular partition openings may have a diameter of, for example, only 50 or 40 μm. In the present transducer 1 shown in FIGS. 1 and 2 the circular partition openings 29, 30, 31 and 32 are conical in the axial direction, as is shown for the partition opening 30 in FIG. 3. The annular partition wall 24 is formed with and surrounds a central passage 37 belonging to the first space 34.

The transducer 1 further comprises a mask wall 38 arranged adjacent the side 35 of the partition wall 24 and in the present case spaced at a small distance from the partition wall 24 by means to be described hereinafter. The mask wall 38 has four mask-wall openings 39, 40, 41 and 42 of slot-shaped and comparatively large cross-sectional area, which traverse the mask wall 38 and which are equispaced at angles of 90° from one another to form the acoustically active passages between the two spaces 34 and 36. The slot-shaped openings 39, 40, 41 and 42 may have a length of approximately 5 mm and a width of approximately 2.2 mm.

In order to obtain different acoustically active cross-sectional areas of the acoustically active passages between the two spaces 34 and 36, which passages are formed by the openings 25, 26, 27, 28 and 29, 30, 31, 32 in the partition wall 24 and 39, 40, 41, 42 in the mask wall 38, which openings can be made to coincide in the direction of the transducer axis 9, the partition wall 24 and the mask wall 38 can be brought into and fixed in two mutually rotated positions relative to the transducer axis 9. In the transducer 1 in the form of a capsule, as shown in FIGS. 1 and 2, the partition wall 24 and the mask wall 38 have been brought into and fixed in such a position relative to one another that the circular partition openings 29, 30, 31, 32 of small cross-sectional area coincide with the slot-shaped mask-wall openings 39, 40, 41 and 42 of larger cross-sectional area. At the location of two coincident openings this results in a very small acoustically active cross-sectional area of the respective passage between the two spaces 34 and 36, which is defined exactly by the cross-sectional area of the circular partition openings 29, 30, 31 and 32 and which is required in order to realize a transducer capsule and the desired frequency response for such a capsule.

As can be seen in FIGS. 1 and 2, the pot 19 of the magnet system 16 in the transducer 1 has a flange 38 which extends transversely of the transducer axis 9 and by which the pot 19 is glued to the partition wall 24, in order to secure the entire magnet system 16, along a continuous substantially circular adhesive joint 43, which is situated in the outer area of the flange 38 and whose inner boundary 44 is represented diagrammatically as a dash-dot line in FIG. 2. It is obvious that in practice such an adhesive joint 43 does not have such an exactly circular boundary 44. In the transducer 1 the pot 19, whose flange 38 is secured to the partition wall 24 by the adhesive joint 43, also serves for acoustically sealing the first space 34 of the transducer 1, which space extends into the partition wall 24 via the central passage 37.

The flange 38 of the pot 19 of the magnet system 16 constitutes not only a fixing element for securing the magnet system 16 to the mounting device 2 but, in a very simple and very advantageous manner, also the mask wall 38 of the transducer 1. Thus, it is achieved that the mask wall 38 of the transducer 1 is not formed by a separate part but by a portion of a part of the transducer 1 which is present anyway, i.e. by the flange 38 of the pot 19 of the magnet system 16 of the transducer 1. This has the advantage that parts costs are reduced and, in particular, that the number of assembly steps and the assembly costs are minimized. A minimal number of assembly steps and minimal assembly costs are of great significance for the mass production of such an electrodynamic transducer 1 because this enables a simpler assembly line to be used. Moreover, no additional tolerance effects are introduced by constructing the flange of the pot as a mask wall, which is favorable for a good reproducibility of the acoustic characteristics of the transducer 1.

In the electrodynamic transducer 1, shown in FIGS. 1 and 2, constructed as a capsule for telecommunication purposes, particularly telephony purposes, the second space 36 at the other side 35 of the partition wall 24 is closed, as already stated above. There is provided a plate-shaped closing member 45 for closing the space 36. The closing member 45 has an opening 46, in the present case of circular cross-section, by which the closing member 45 is mounted on the outer circumferential surface 47 of the pot 19 of the magnet system 16 with an acoustically sealed fit. The closing member 45 has a peripheral portion 48 surrounding the opening 46, by which the closing member 45 is connected to the outer wall 3 of the mounting device 2 in an acoustically sealed and mechanically rigid manner. The mounting device 2, i.e. its outer wall 3, thus constitutes a part bounding the second space 36 in the present transducer 1. The mounting device 2 and the closing member 45 are made of the same synthetic material and are mechanically secured to one another by ultrasonic welding. At the location of the opening 46 the closing member 45 is connected very simply to the outer circumferential surface 47 of the pot 19 of the magnet system 16 only by means of a mechanical press fit.

In the transducer 1 shown in FIGS. 1 and 2 the partition wall 24 and the mask wall 38 can also be brought into and held in another position relative to each other than shown in FIGS. 1 and 2. In the transducer 1 shown in FIGS. 1 and 2 the partition wall 24 and the mask wall 38, i.e. the flange 38 of the pot 19 of the magnet system 16, can be brought into and held in a position relative to one another in which the slot-shaped partition openings 25, 26, 27 and 28 coincide with the slot-shaped mask-wall openings 39, 40, 41 and 42. At the location of two coincident openings this results in a large acoustically active cross-sectional area of the relevant passage between the two spaces 34 and 36, which passage is defined exactly by the cross-sectional area of the mask-wall openings 39, 40, 41 and 42 and which is required in order to realize a transducer constructed as a loudspeaker and the desired frequency response for such a loudspeaker. However, in such a transducer 1 constructed as a loudspeaker the space 36 is then open by omitting the closing member 45.

In the transducer 1 in accordance with the invention shown in FIGS. 1 and 2 it is achieved in a particularly simple manner that relative to the transducer axis 9 the closing member 45 of the transducer 1 is situated within the axial boundaries of the magnet system 16 of the transducer 1, i.e. requires no additional space in the direction of the transducer axis 9. This leads to a very small mounting depth of the transducer 1 in the direction of its transducer axis 9, so that such a transducer 1 is also suitable for mounting in telecommunication apparatuses of very flat construction.

Viewed in the direction of the transducer axis 9 of the transducer 1 in accordance with the invention shown in FIGS. 1, 2 and 3 each partition opening 29, 30, 31, 32 of small cross-sectional area in the partition wall 24 is situated between two spacer elements 49 and 50, 51 and 52, 53 and 54, and 55 and 56, respectively, which are arranged between the partition wall 24 and the mask wall 38 and have substantially the same distance from the central passage 37 in the partition wall 24, which spacer elements keep the partition wall 24 and the mask wall 38 spaced at a small distance from one another. Two spacer elements 49 and 50, 51 and 52, 53 and 54, and 55 and 56, respectively, each time bound a circumferentially bounded duct-like gap 57, 58, 59, 60 situated between the partition wall 24 and the mask wall 38 and leading to the passage 37 in the partition wall 24 to form an acoustic resistance. Each of the spacer elements 49, 50, 51, 52, 53, 54, 55, 56 is integral with the partition wall 24. During the manufacture of the mounting device 2, with which the partition wall 24 is integral, the spacer elements are formed simply and substantially without any additional measures in the same injection-moulding process in which the mounting device 2 is manufactured. In the present transducer 1 shown in FIGS. 1, 2 and 3 each of the spacer elements 49 to 56 has a height of approximately 50 μm in the direction of the transducer axis 9. It is to be noted that for the clarity of the drawing the height of the spacer 58 has been exaggerated in relation to the other parts in FIG. 3. In a plan view of the spacer elements 49 to 56 in the direction of the transducer axis 9 the spacer elements 49 to 56 are of rectangular cross-section. As is shown in FIG. 2, the spacer elements 49 to 56 are each situated at the location of one end of a slot-shaped mask-wall opening 39, 40, 41, 42, which has the advantage that the spacer elements 49 to 56 also form barriers for the adhesive by which the mask wall 38 is connected mechanically and in an acoustically sealed manner to the partition wall 24 along the adhesive joint 43.

As a result of the provision of the pairs of spacer elements 49 and 50, 51 and 52, 53 and 54, and 55 and 56, a partition opening 29, 30, 31, 32 of small cross-sectional area being situated between each pair of spacer elements 49 to 56 in a plan view of the transducer 1 along the transducer axis 9, it is achieved in a particularly simple manner that for each opening 29, 30, 31, 32 a so-called acoustic bypass resistance is realized by each of duct-like gaps 57, 58, 59, 60 bounded by two spacer elements 49 and 50, 51 and 52, 53 and 54, and 55 and 56, respectively, and the partition wall 24 and the mask wall 38, which acts in addition and parallel to the acoustic impedance formed by an opening 29, 30, 31, 32 of small cross-sectional area, resulting in a smaller overall acoustic impedance at the location of each opening 29, 30, 31, 32 of small cross-sectional area. This has the advantage that it provides a reduced Q factor and hence a stronger damping of the Helmholtz resonators formed by means of the two spaces 34 and 36 of the transducer 1, resulting in a correct and smooth frequency response of the transducer 1. A special advantage is that the duct-like gaps 57, 58, 59, 60 acting as acoustic bypass resistances are realized in a particularly simple manner with the aid of the adjacent walls 24 and 38 by additionally providing only the spacer elements 49 to 56. Another special advantage is that in a transducer 1 each acoustically active duct-like gap 57, 58, 59, 60 is circumferentially bounded in a very exact manner by two spacer elements 49 and 50, 51 and 52, 53 and 54, and 55 and 56, respectively, between the two walls 24 and 28 and by the two walls 24 and 28 and has a comparatively accurately defined length up to the central passage 37 in the partition wall 24, which is advantageous for an accurately defined value of the acoustic bypass resistance formed by such a duct-like gap 57, 58, 59, 60.

In the embodiment of a transducer 1 as described above it is possible to provide more than one opening 29, 30, 31, 32 of small cross-sectional area between two respective spacer elements 49 and 50, 51 and 52, 53 and 54, and 55 and 56. For example, two or even more of such openings of small cross-sectional area may be provided between two respective spacer elements. It is also possible to provide a sequence of alternately a spacer element and an opening of small cross-sectional area. In a plan view along the transducer axis 9 the spacer elements 49 to 56 may have a non-rectangular cross-sectional shape, for example a trapezoidal, triangular, oval or other shape. Moreover, the height of the spacer elements 49 to 56 in the direction of the transducer axis 9 may have another value than 50 μm, the height of the spacer elements 49 to 56 being for example only 20 μm or, conversely, 100 μm. In addition, such a transducer 1 may comprise more than four pairs of spacer elements, at least one partition opening of small cross-sectional area being provided between each pair of spacer elements. In such a transducer 1 the spacer elements 49 to 56 may also extend up to the passage 37 in the partition wall 24.

The invention is not limited to the exemplary embodiment of the transducer described hereinbefore. For example, the flange of the pot of a pot-core magnet system as used in the transducer described herein, which flange serves as a mask wall, may also adjoin a partition wall of such a mounting device at the side facing the diaphragm. In a transducer in accordance with the invention it is also possible to use another magnet system than a pot-core magnet system, for example a ring-core magnet system. Moreover, the partition wall may have, for example, more than two different types of partition openings, which can be made to coincide with, for example, more than one type of mask-wall openings in a mask wall formed by a flange in different positions of the partition wall and the mask wall relative to one another. Instead of providing only one circular opening of small diameter in a part of the partition wall it is also possible to provide two or more of such circular openings of even smaller diameter, which are then situated between two spacer elements. Such openings of circular cross-section may have a conical shape instead of a cylindrical shape in the axial direction. Alternatively, the openings of small cross-sectional area may be provided in a mask wall of a transducer in order to form an acoustically active passage and the openings of large cross-sectional area, which can be made to coincide with said openings in the mask wall, may be provided in a partition wall of a transducer in order to also form an acoustically active passage, which partition wall is spaced at a small distance from the mask wall by means of spacer elements. The steps in accordance with the invention can also be applied to a transducer in which the partition wall and the mask wall are merely brought into and fixed in a relative position with respect to one another.

I claim:

1. An electroacoustic transducer (1) having a diaphragm (5) constructed to be capable of vibration parallel to a transducer axis (9), which transducer comprises a partition wall (24) facing the back (13) of the diaphragm, which partition wall substantially extends transversely of the transducer axis (9) and is transversed by at least one partition opening (25, 26, 27, 28, 29, 30, 31, 32) to form a passage between a first space (34) situated between the diaphragm (5) and one side (33) of the partition wall (24) and a second space (36) situated at the other side (35) of the partition wall (24), which partition wall is formed with and surrounds a central passage (37) belonging to the first space (34), and a mask wall (38) arranged adjacent one (35) of the two sides (33, 35) of the partition wall (24) and having at least one mask-wall opening (39, 40, 41, 42) to form a passage between the two spaces (34, 36), which mask wall is connected in a mechanically rigid manner to the partition wall (24) by means of a continuous acoustically sealed joint (43) situated radially outside the openings (25, 26, 27, 28, 29, 30, 31, 32, 39, 40, 41, 42) in the two walls (24, 38), one (24) of the two walls (24, 38) being provided with at least one opening (29, 30, 31, 32) having a small cross-sectional area of at the most 0.2 $mm^2$ and an opening (39, 40, 41, 42) of large cross-sectional area in the other wall (38) being coincident with at least one opening (29, 30, 31, 32) of small cross-sectional area in the one wall (24) to form at least one passage having a small acoustically active cross-sectional area between the two spaces (34, 36) in the direction of the transducer axis (9), characterized in that each opening (29, 30, 31, 32) of small cross-sectional area in one (24) of the two walls (24, 38) is situated between two spacer elements (49 and 50, 51 and 52, 53 and 54, 55 and 56, respectively) arranged between the two walls (24, 38) and having substantially the same distance from the central passage (37) in the partition wall (24), and each time two spacer elements (49 and 50, 51 and 52, 53 and 54, 55 and 56, respectively) together with the two walls (34, 38) circumferentially bound a duct-like gap (57, 58, 59, 60) situated between the two walls (24, 38) and leading to the passage (37) in the partition wall (24) to form an acoustic resistance.

2. A transducer (1) as claimed in claim 1, characterized in that each spacer element (49, 50, 51, 52, 53, 54, 55, 56) is integral with one (24) of the two walls (24, 38).

3. A transducer (1) as claimed in claim 2, characterized in that each spacer element (49, 50, 51, 52, 53, 54, 55, 56) has a height of between 20 μm and 50 μm in the direction of the transducer axis (9).

4. A transducer (1) as claimed in claim 3, characterized in that each opening (29, 30, 31, 32) having a small cross-sectional area is of circular cross-section, and the diameter of each such opening (29, 30, 31, 32) of circular cross-section is smaller than 0.3 mm in its acoustically active cross-sectional area.

5. A transducer (1) as claimed in claim 1, characterized in that the diameter of each such opening (29, 30, 31, 32) of circular cross-section is 0.2 mm in its acoustically active cross-sectional area.

6. A transducer (1) as claimed in claim 5, characterized in that each such opening (29, 30, 31, 32) of circular cross-section has a conical shape in its axial direction.

7. A transducer as claimed in claim 4, characterized in that each such opening of circular cross-section has a conical shape in its axial direction.

8. A transducer as claimed in claim 2, characterized in that each opening having a small cross-sectional area is of circular cross-section, and the diameter of each such opening of circular cross-section is smaller than 0.3 mm in its acoustically active cross-sectional area.

9. A transducer as claimed in claim 1, characterized in that each spacer element has a height of between 20 μm and 50 μm in the direction of the transducer axis.

10. A transducer as claimed in claim 1, characterized in that each opening having a small cross-sectional area of circular cross-section and the diameter of each such opening of circular cross-section is smaller than 0.3 mm in its acoustically active cross-sectional area.

* * * * *